US006119930A

United States Patent [19]

Lunstra et al.

[11] Patent Number: 6,119,930

[45] Date of Patent: Sep. 19, 2000

[54] CARTON WITH INTEGRAL DISCRETE COMPARTMENT

[75] Inventors: Keith Lunstra, Valley Springs; Mark Hill, Sioux Falls, both of S. Dak.

[73] Assignee: Bell Paper Box, Inc., Sioux Falls, S. Dak.

[21] Appl. No.: 09/370,147

[22] Filed: Aug. 9, 1999

[51] Int. Cl.[7] ..... B65D 5/4805

[52] U.S. Cl. ..... 229/400; 229/116; 229/117; 229/120.15; 229/906

[58] Field of Search ..... 229/4.5, 116, 117, 229/120.15, 120.18, 400, 405, 902, 904, 906

[56] References Cited

U.S. PATENT DOCUMENTS

| | | | |
|---|---|---|---|
| 1,556,514 | 10/1925 | Feldman | 229/120.18 |
| 4,126,261 | 11/1978 | Cook | 229/904 |
| 4,431,128 | 2/1984 | Dirico | 229/904 |
| 4,955,528 | 9/1990 | Schluckebier | 229/902 |
| 5,476,215 | 12/1995 | Baroud | 229/405 |
| 5,626,283 | 5/1997 | Mellon | 229/400 |
| 5,720,429 | 2/1998 | Cordle | 229/405 |

FOREIGN PATENT DOCUMENTS

| | | | |
|---|---|---|---|
| 642389 | 10/1993 | Australia | 229/904 |
| 614289 | 6/1935 | Germany | 229/400 |

*Primary Examiner*—Gary E. Elkins

[57] ABSTRACT

The present invention is directed to a carton for co-packaging two distinct food substances, in two distinct cavities. This is accomplished by means of a single blank of paperboard which is creased, folded and glued so as to form one major cavity and one minor cavity, said minor cavity being an integral discrete compartment.

3 Claims, 5 Drawing Sheets

CARTON WITH INTEGRAL DISCRETE COMPARTMENT

BACKGROUND OF THE INVENTION

At fast food restaurants and at take-out counters, french fries are often sold in paperboard cartons. Many people like to apply ketchup to french fries. If it is applied directly to the fries in the container, they will tend to become soggy. Alternatively, one can obtain a small separate container of ketchup, in which a french fry may be dipped immediately before it is eaten. But this latter gourmet preference has the disadvantage of requiring two separate containers. With the human limitation of two hands, there is one hand to hold the container of fries and one to move the fries from container to mouth. So a stable and convenient surface is required to support the ketchup. But, since fast food customers are often on the move, they want to carry the fries with them as they walk or ride. A solution to the problem is a container for the fries, which includes an integral, discrete compartment for the ketchup.

DETAILED DESCRIPTION OF THE INVENTION

In accordance with the present invention, a carton adapted for french fries, is formed from a single die-cut blank of paperboard, or similar material. The carton, as formed, includes on its inner periphery a discrete compartment adapted for holding a portion of some different food substance, such as ketchup.

Figure 1:
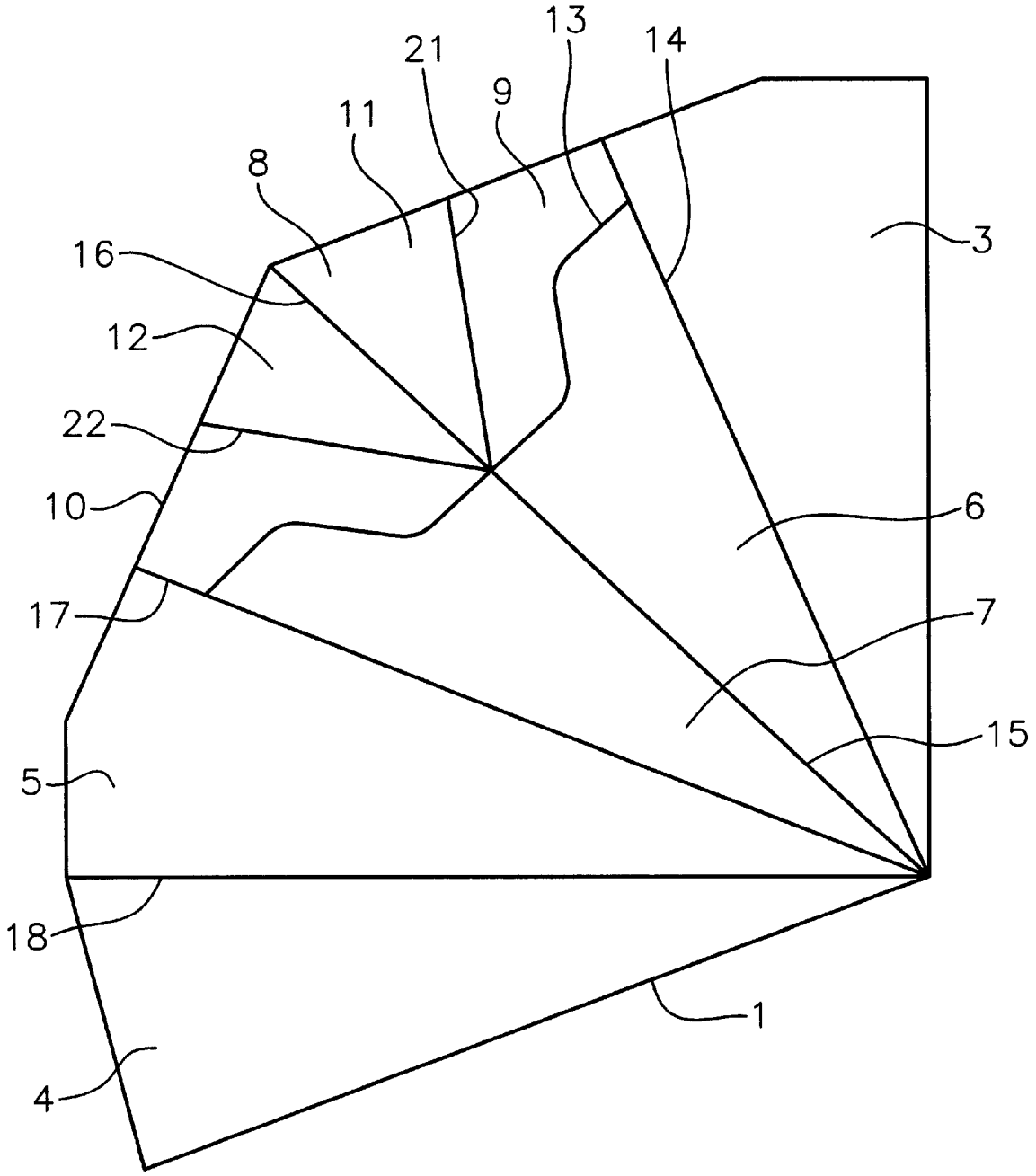
FIG. 1 illustrates a top plan view of the unfolded, die-cut blank.

The unique carton, including a integral and discrete compartment will be more fully appreciated and understood by having reference to the drawings which illustrate two preferred embodiments thereof Directing attention to FIG. 1 of the drawings, a blank is die-cut out of paperboard. It is also die-cut along line 13. It is creased for folding along lines 14, 15, 16, 17 and 18, and also along lines 21 and 22. Crease 14 defines the outer back wall panel 3. Crease 15 defines the outer front wall panels 6 and 7, between creases 14 and 17. Outer back wall panel 5 is defined between creases 17 and 18. Inner back wall panel 4 is defined by the crease 18.

Figure 2:
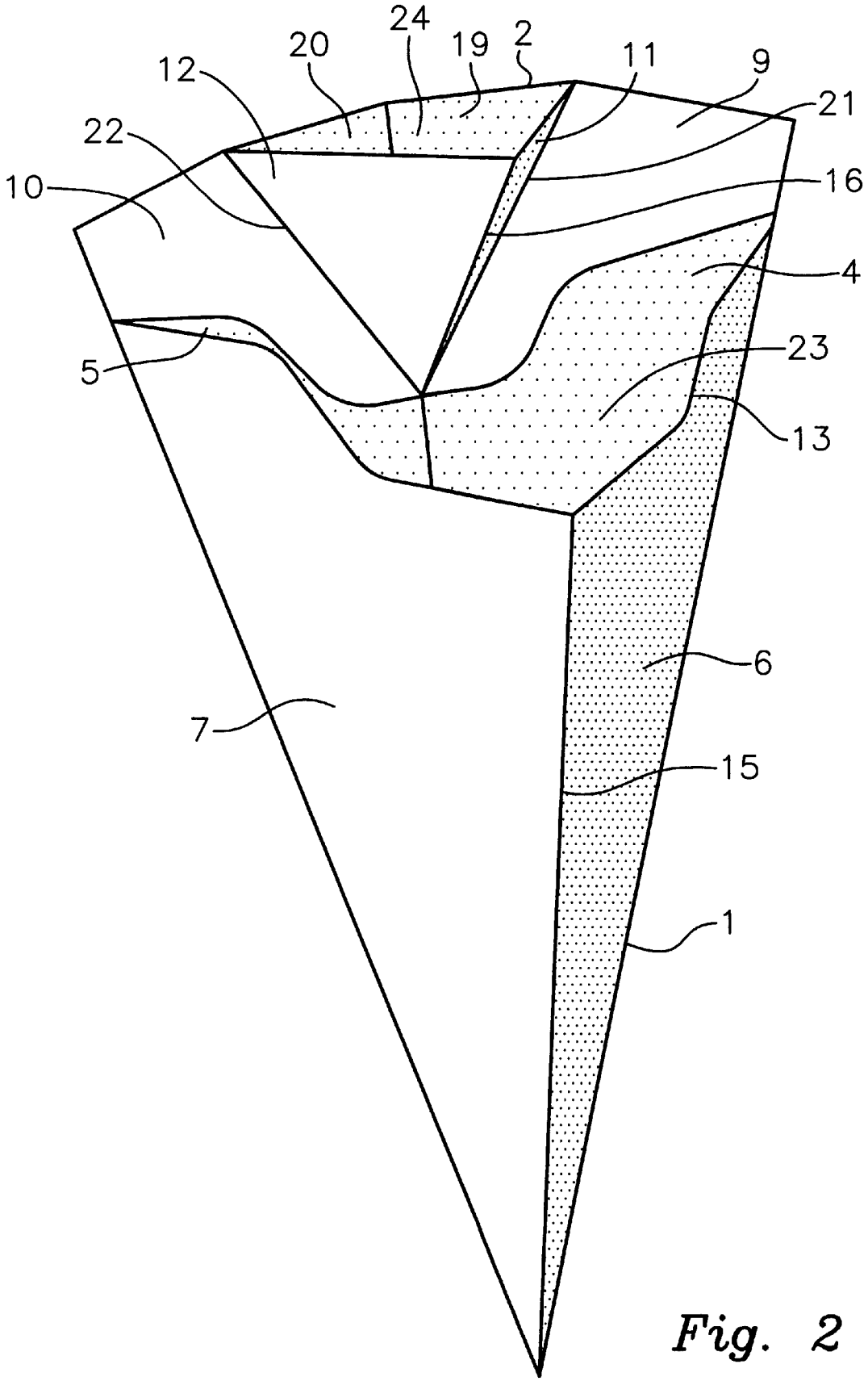
FIG. 2 illustrates a perspective view of the fully assembled carton.

Directing attention to FIG. 2 of the drawings, the carton is formed by folding panel 4 under panel 3 and secured by gluing. A four sided "cone" is formed by outer wall panels 3, 5, 6 and 7, and inner wall panel 4, which is adhered to the inner periphery of panel 3. Die-cut 13 which defines the top of panels 6 and 7 also defines the bottom of the integral discrete compartment 2, which comprises shoulders 9 and 10 and inner compartment wall panels 11 and 12. The shoulders 9 and 10 are secured by gluing to panels 4 and 5. The front wall panels 6 and 7 are extended out from the back wall panels 4 and 5. Panel 11 is defined between creases 16 and 21. Panel 12 is defined between creases 16 and 22. Thus, a cavity 23 is formed between front wall panels 6 and 7 and the back wall panels 4 and 5. Similarly, inner compartment panels 11 and 12, are extended out from compartment walls 19 and 20, thus forming compartment cavity 24.

When formed, as shown in FIG. 2, the carton 1, provides one cavity 23 for containing one type of food (e.g. french fries) and another discrete compartment cavity 24, for containing another type of food (e.g. ketchup). The carton can be held in one hand, while the other hand manipulates the food to the mouth.

Figure 3:
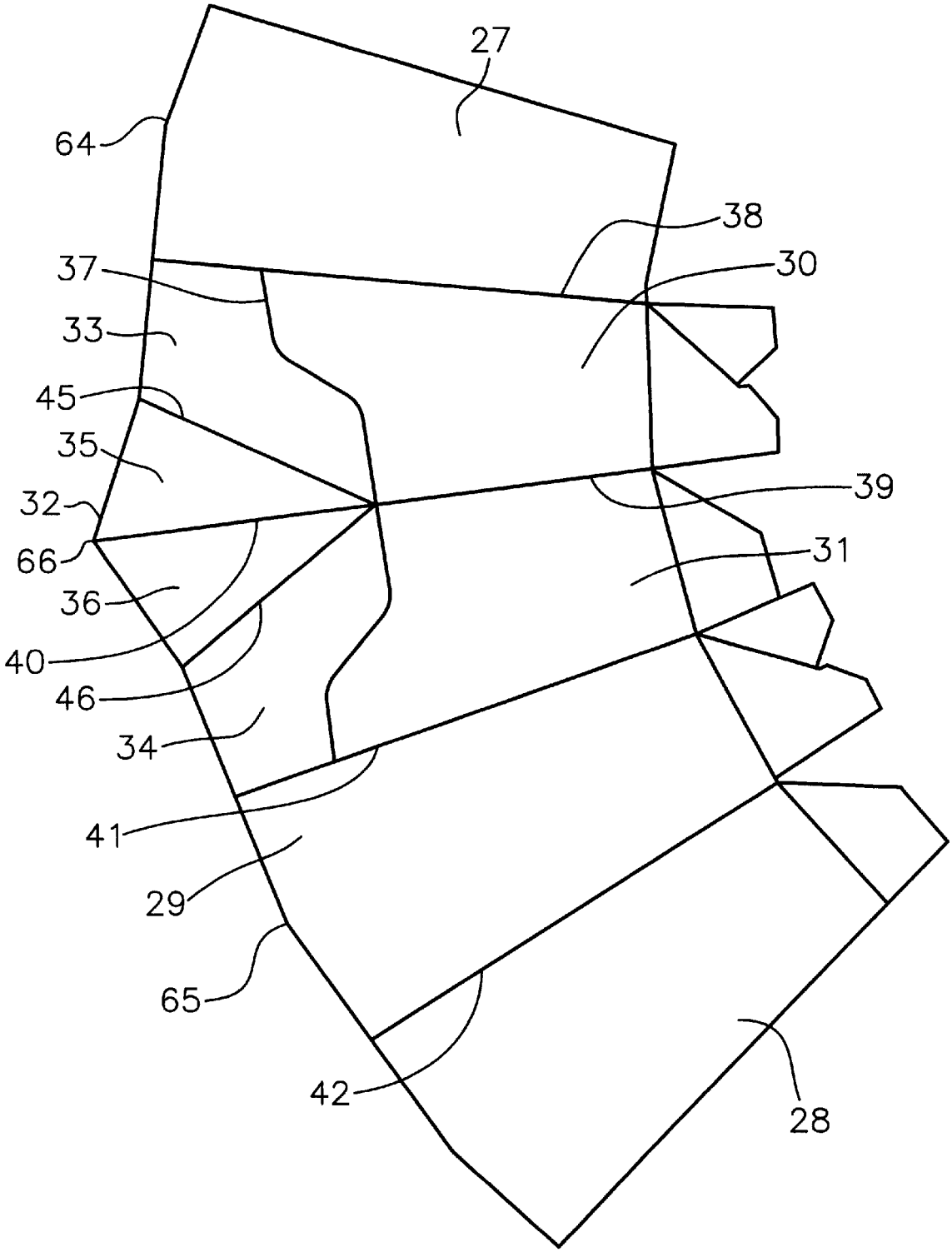
FIG. 3 illustrates a top plan view of the unfolded, die-cut blank of a second embodiment of the invention.
Figure 4:
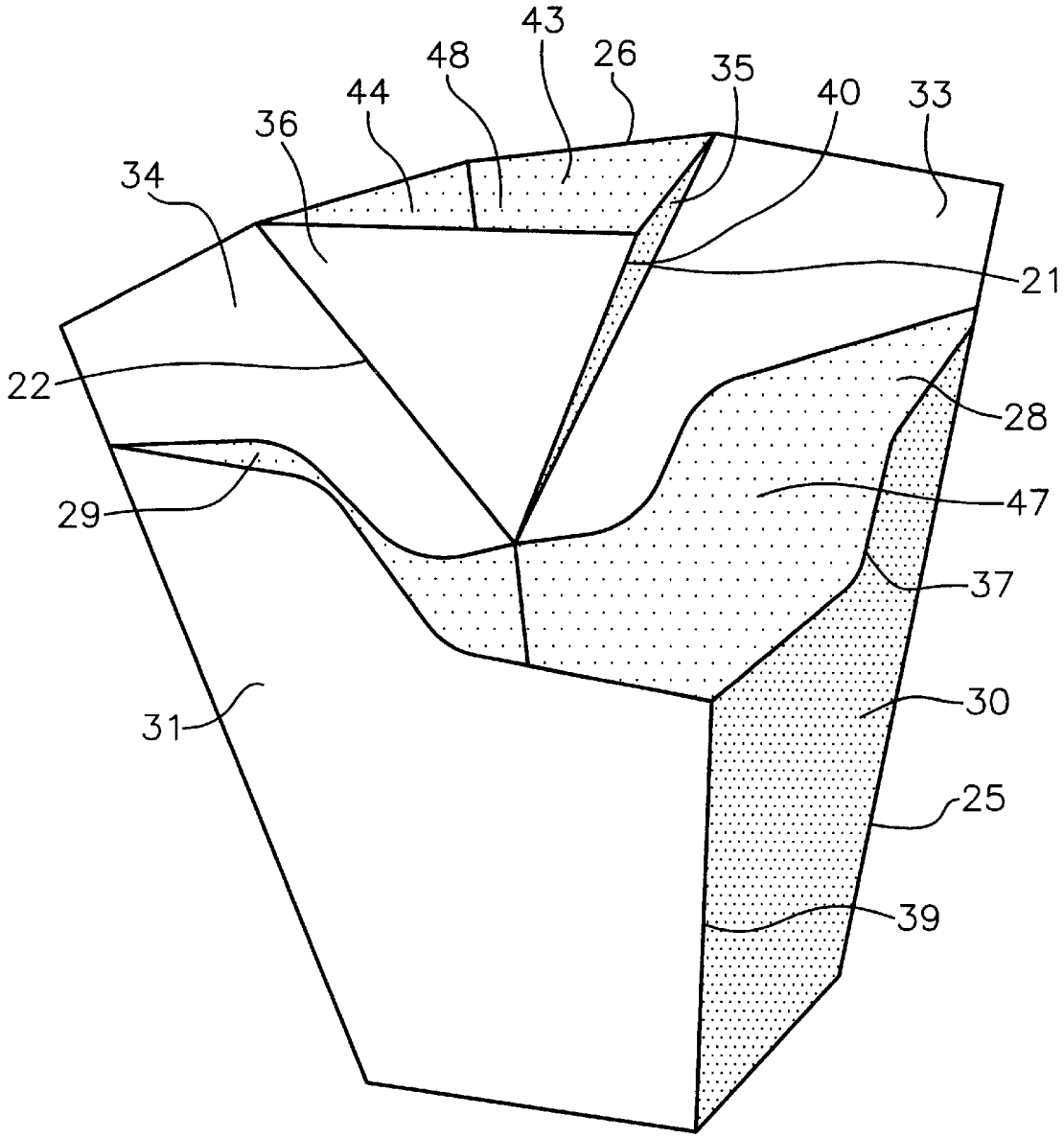
FIG. 4 illustrates a perspective view of the fully assembled carton of a second embodiment of the invention.

In FIG. 3 and 4, a different embodiment of the invention is shown. It is essentially the same as that shown in FIGS. 1 and 2, except that the carton has a flat bottom so that it can be set on a table, counter or other available surface.

Directing attention to FIG. 3 of the drawings, a blank is die cut out of paperboard. It is also die-cut along line 37. It is creased for folding along lines 38, 39, 40, 41 and 42. It is also creased for folding along lines 45 and 46. Crease 38 defines the outer back wall panel 27. Crease 39 defines the outer front wall panels 30 and 31, between creases 38 and 41. Outer back wall panel 29 is defined between creases 41 and 42. Inner back wall panel 28 is defined by the crease 42.

Directing attention to FIG. 4 of the drawings, the carton is formed by folding panel 28 under panel 27 and secured by gluing. A four sided "box" is formed by the outer wall panels 27, 29, 30 and 31, and inner wall panel 28, which is glued to the inner periphery of panel 27. Die cut 37, which defines the top of panels 30 and 31, also defines the bottom of the integral discrete compartment 26, which comprises shoulders 33 and 34 and inner compartment and inner compartment wall panels 35 and 36. The shoulders 33 and 34 are secured by gluing to panels 28 and 29. The front wall panels 30 and 31 are extended out from the back wall panels 28 and 29. Panel 35 is defined between creases 40 and 45. Panel 36 is defined between creases 40 and 46. Thus, a cavity 47 is formed between front wall panels 30 and 31 and the back wall panels 28 and 29. Similarly, inner compartment panels 35 and 36 are extended out from compartment wall panels 43 and 44, thus forming the compartment cavity 48.

The bottom of the carton 25 is formed by interlocking creased and glued panels very well known in the art, and standard to most such cartons, as are formed from a single blank and capable of being quickly and easily formed into a carton.

When formed as shown in FIG. 4, the carton 25 provides one cavity 47 for containing one type of food (e.g. french fries) and another discrete compartment cavity 48 for containing another type of food (e.g. ketchup). The carton can be held or set upon an available surface.

Figure 5:
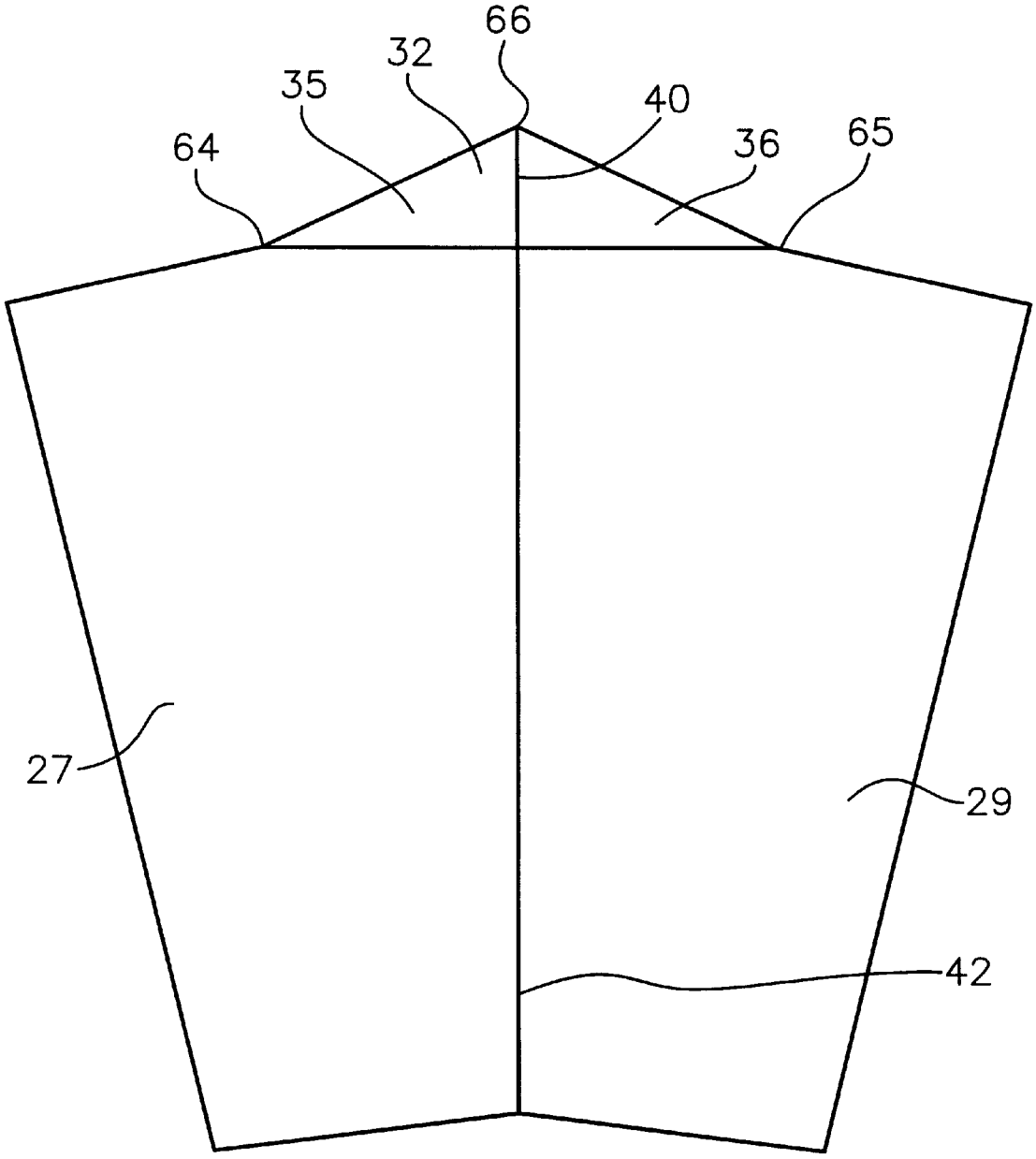
FIG. 5 illustrates a rear view of the partially assembled carton.

FIG. 5 of the drawings illustrates a specific aspect of the invention. The panels 27, 28 and 29 are die-cut on their upper periphery to form crest points 64 and 65. The compartment forming position 32 has a crest point 66 (at the tip of crease 40) that extends above panels 27 and 29. This provides a surface that can be manually engaged and pulled out to form the compartment cavity 48. While this feature is illustrated only as to the second embodiment of the invention, it is equally applicable to the embodiment, illustrated in FIGS. 1 and 2, which is formed with similar crest points.

It will be appreciated, that due to the unique structure of the present invention the bottom of compartment and its side seams are relatively leak proof, so that the compartment can securely hold a semi-liquid substance like ketchup.

It will be further appreciated that the carton not only provides a means of co-packaging various food-condiment combinations, but can also function as a container for a single food substance, like french fries for people who prefer them without ketchup. In single food substance use, the integral discrete compartment portion is not extended from the back wall panels and remains a part thereof.

It will also be appreciated, as illustrated in FIG. 5, that the integral discrete compartment has a crest point which extends substantially above the back wall panels, providing a convenient surface to manually engage and pull out, thus forming the integral discrete compartment cavity.

Other modifications and expedients will be apparent to those of ordinary skill in the art and are considered to fall within the scope of the invention as defined by the claims appended hereto.

What is claimed:

1. A carton for co-packaging two distinct food substances, said carton being formed from a single blank of paperboard creased so as to comprise five adjacent panels each having an upper end wider than its lower end, the panels on the opposite sides of the single blank being overlapped and glued to form one back wall panel of a four sided carton having two back wall panels and two front wall panels, each of the two front wall panels having a portion of its upper end cut and folded so as to form shoulder portions which are glued to the adjacent back wall panels, and a discrete compartment cavity which is creased and folded out from said adjacent back wall panels.

2. The carton of claim 1, in which the said panels are of triangular shape, their lower ends comprising a common terminus.

3. The carton of claim 1, in which the said panels are of trapezoidal shape and have lower end portions that are folded and interlocked to form a common terminus.

* * * * *